US008075320B2

(12) United States Patent
Schmückle et al.

(10) Patent No.: US 8,075,320 B2
(45) Date of Patent: Dec. 13, 2011

(54) MULTIPOLE MATRIX CONNECTOR

(75) Inventors: Andreas Schmückle, Flein (DE); Matthias Kassner, Heilbronn (DE); Uwe Ellsässer, Bietigheim-Bissingen (DE); Eckhard Schewe, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 12/676,080

(22) PCT Filed: Sep. 23, 2008

(86) PCT No.: PCT/EP2008/008042

§ 371 (c)(1),
(2), (4) Date: May 4, 2010

(87) PCT Pub. No.: WO2009/043508

PCT Pub. Date: Apr. 9, 2009

(65) Prior Publication Data

US 2010/0216346 A1 Aug. 26, 2010

(30) Foreign Application Priority Data

Sep. 26, 2007 (DE) ..... 10 2007 045 903

(51) Int. Cl.
*H01R 12/00* (2006.01)

(52) U.S. Cl. ..... 439/67

(58) Field of Classification Search ..... 439/67, 439/73, 77, 329, 493, 499, 462
See application file for complete search history.

(56) References Cited

U.S. PATENT DOCUMENTS

| | | | | |
|---|---|---|---|---|
| 4,647,125 | A | 3/1987 | Landi et al. | |
| 4,975,068 | A | 12/1990 | Squires | |
| 5,971,773 | A * | 10/1999 | Riddle | 439/67 |
| 6,095,856 | A * | 8/2000 | Horan et al. | 439/567 |
| 6,960,094 | B2 * | 11/2005 | Tomonari et al. | 439/329 |
| 2002/0123259 | A1 | 9/2002 | Yatskov et al. | |

FOREIGN PATENT DOCUMENTS

| | | | |
|---|---|---|---|
| CA | 2 490 096 | A1 | 12/2003 |
| DE | 3 215 191 | A1 | 10/1983 |
| EP | 0 338 717 | A2 | 10/1989 |
| EP | 1 204 169 | A1 | 5/2002 |
| WO | 00/55946 | A1 | 9/2000 |

* cited by examiner

*Primary Examiner* — Tulsidas C Patel
*Assistant Examiner* — Phuong Nguyen

(57) ABSTRACT

The invention concerns a matrix connector comprising a first pair of plug-in connectors and a second pair of plug-in connectors, in which the first pair of plug-in connectors has a housing, in which at least one flexible printed circuit board with at least one array of contacts is designed, which is contacted with at least one second array of contacts, which is designed in the second pair of plug-in connectors.

10 Claims, 3 Drawing Sheets

MULTIPOLE MATRIX CONNECTOR

CROSS-REFERENCE TO RELATED APPLICATIONS

The present application claims the benefit of International Patent Application No. PCT/EP2008/008042, filed Sep. 23, 2008, which in turn claims priority to German Patent Application No. 10 2007 045 903.5, filed Sep. 26, 2007, the entire disclosures of both which are incorporated by reference herein.

BACKGROUND OF THE INVENTION

1. Field of Invention

The invention concerns a matrix connector and in particular a multipole matrix connector, according to the preamble of claim 1.

The invention concerns a matrix connector and, in particular, a multipole matrix connector.

The invention concerns a matrix connector with an integrated flexible printed circuit board which has an array of contacts. The connector in the present invention thus comprises a matrix connector pair with a first matrix connector with a first flexible printed circuit board and a first array of contacts, and a second matrix connector with a second printed circuit board and second array of contacts. The second array of contacts corresponds to and contacts the first array of contacts.

The invention thus concerns a detachable matrix connector for contactable connection of printed circuit boards, and In particular flexible printed circuit boards.

2. Description of the Related Art

In the state of the art matrix connectors with multipole contact configurations already known with contact arrays which are flat and are formed so as to mutually correspond.

For example, CA 2 490 096 shows a matrix connector constructed from a first array of contacts with formed connection pins and a second matrix with contact holes, into which the matrix connector can immerse with the connection pins, for detachable connections and for contact with a second matrix connector, in other words the matrix box connector.

In DE 3 215 191 an arrays of contacts is revealed in which contacts between the array of contact fields, or its contact sites, which are formed as open contacts sites, can be connected with a bridging die to corresponding contact sites, essentially by a key operation, so that current paths can be produced, through local and punctiform connection of different contact points of the array of contacts with the corresponding contact sites. This layout forms the basis of the peculiarity that the array of contacts is arranged with open contact sites in a flexible connecting cable and that this does not have to be immersed in the corresponding contact arrangement.

In the state of the art other similar contact arrangements are known, which all have the problem that with the increasing number of contacts in a matrix connector, and particularly with immersed contacts, the contact forces increase substantially and through this the plug-in and pulling-out forces are negatively influenced in such a matrix connector.

SUMMARY OF THE INVENTION

A further disadvantage of such matrix connectors is the problem of the tolerances and thus the position of the corresponding contact pair in the respective opposite array of contacts. If the corresponding contacts are not correctly aligned with each other, there will either be no contact, or the matrix connector cannot be operated and plugged in. Also the manufacturing tolerances still result in increased plug-in and pulling-out forces. A further disadvantage of the known matrix connectors is that the normal force of the contact over the whole contact field cannot be arbitrarily adjusted.

It is thus task of the present invention to supply a matrix connector in such a manner that the normal forces of the contact are scalable and adjustable, while at the same time the contacting is improved and higher contact security is achieved.

The task is achieved in the present invention by providing a matrix connector in which flexible printed circuit boards are integrated, each of which has an array of contacts that can be connected by touching a corresponding array of contacts in the mating connector, in which in one of the pair of plug-in connectors of the matrix connector the flexible printed circuit board is integrated into spring-loaded housing inserts. The housing inserts have guide pins which accomplish the alignment of the matrix connector and particularly the array of contacts with the corresponding array of contacts. These housing inserts are inserted into a further housing with spring-loading, in which further guiding device is present for alignment of the housing inserts for the corresponding matrix connector and thus the corresponding array of contacts. The multipole matrix connector in the present invention thus comprises a pair of plug-in connectors, a first connector, which flexibly accommodates the housing inserts and the flexible printed circuit boards with their array of contacts mounted inside, and a corresponding matrix connector, comprising a further pair of printed circuit boards, preferably flexible printed circuit boards and a guiding device, which fits into the corresponding guiding device of the housing in the first matrix connector pair.

Thus the connector, or on other words the matrix connector has first guiding devices which ensure that the array of contact fields of the pair of plug-in connectors in the multipole matrix connector are aligned to each other and a second guiding device, which ensures that the housings of the matrix connector pair are also aligned with each other. By arrangement of different arrays of contacts in this multipole matrix connector, a variety of arrays of contacts can be produced with flexible printed circuit boards, which due to their spring-loaded casing inserts can be impinged with varying contact spring forces.

The multipole matrix connector in the present invention is particularly suitable for applications in ultrasonic technology and for contacting and production of pictures in the ultrasonic process. In order to improve the contact security in the plugged-in state of the matrix connector pair in the present invention, the guiding device can be so formed that it includes a coding and a lock. Preferably the housing inserts are designed with helical springs, particularly with several helical springs, so that a stable spring force is achieved, which is thus distributed over the dimensions housing inserts. In an advantageous extension of the invention, the flexible conducting paths are bound to the housing inserts in several suitable places particularly with pass bands and held firmly in their place. Preferably besides the pass bands, essentially helical connections are further affixed on the flexible printed circuit board elements to join these with the housing inserts.

BRIEF DESCRIPTION OF THE DRAWINGS

In another advantageous design of the matrix connector in the present invention the housing inserts include several guide ribs on the sides, which additionally contribute to the exact alignment of the arrays of contacts. Further advantages and appropriate construction of the invention are explained in the further claims of the description of the figures and the drawing. Shown are:

DETAILED DESCRIPTION OF THE PREFERRED EMBODIMENTS

Figure 1:
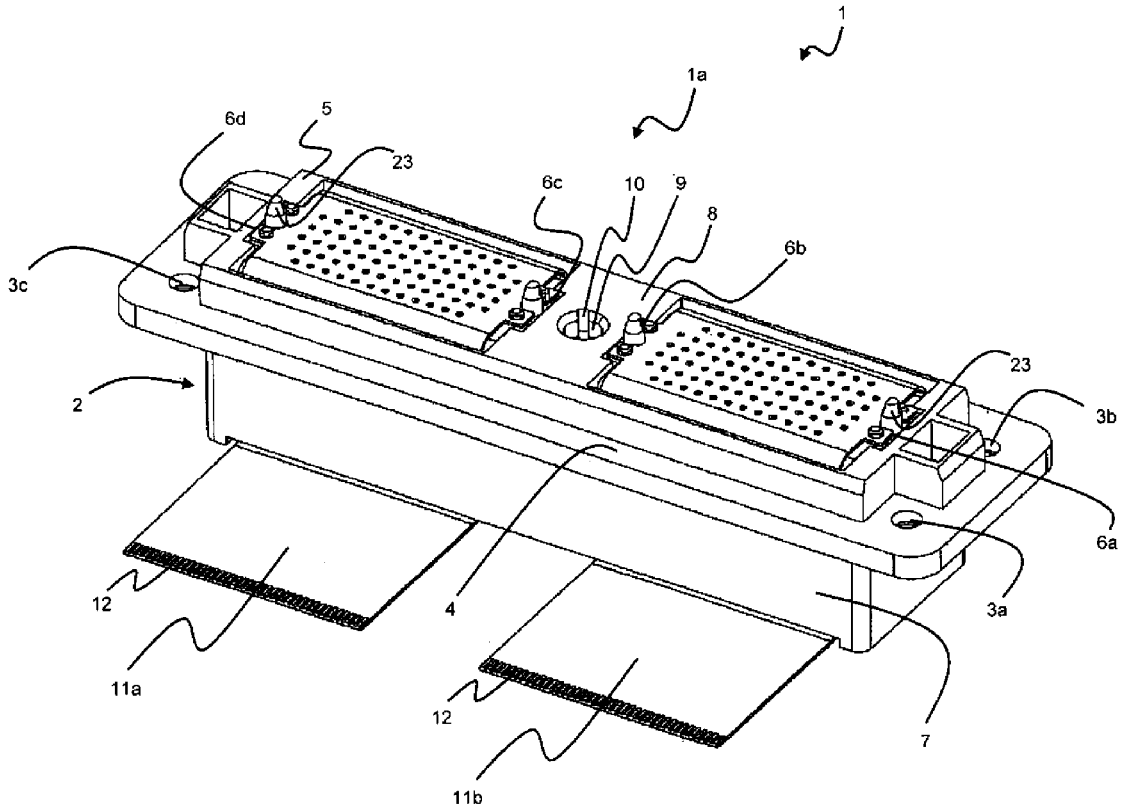
FIG. 1*a* perspective view of part of the matrix connector with mounted flexible conducting paths, which each include an array of contacts, FIG. 2*a* slightly rotated perspective view of FIG. 1 of the flexible conducting paths and spring-loaded housing inserts shown in FIG. 1, FIG. 3*a* perspective view of the matrix connector element corresponding to FIG. 1.

The essentially corresponding characteristics of the matrix connector are labelled in all figures with the same reference characters. Similar characteristics are labelled with the same reference signs, but provided additionally with small letters; different characteristics are labelled with different reference characters.

Figure 3:
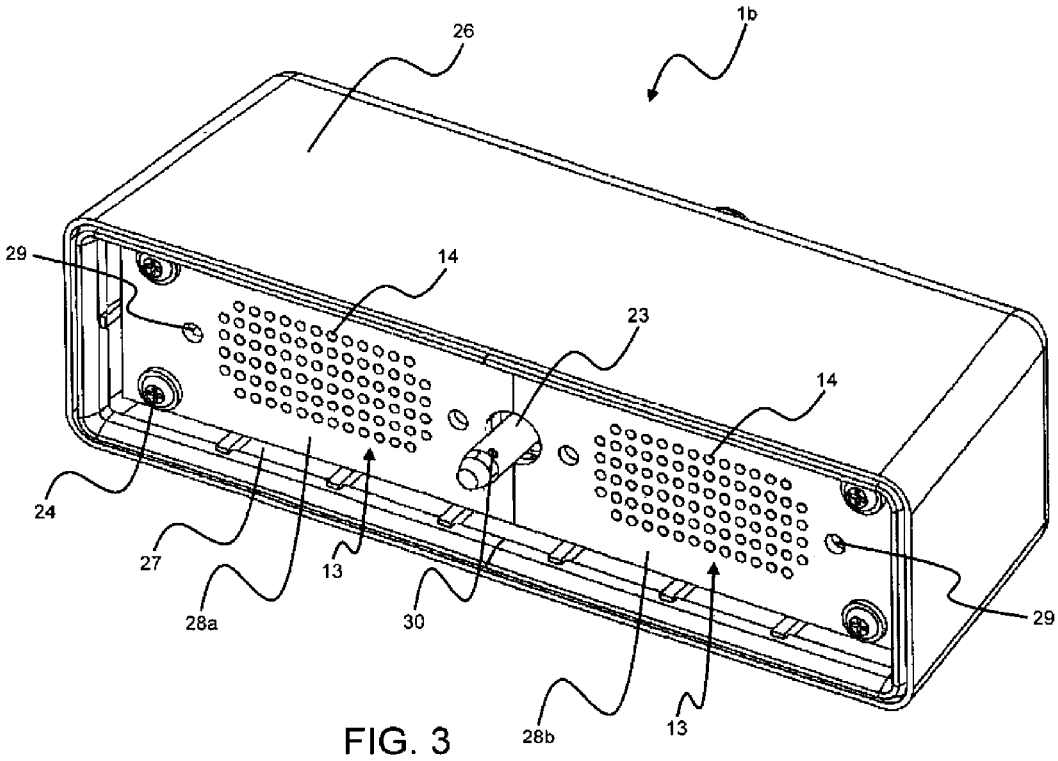

The present invention concerns a matrix connector 1 and in particular a multipole matrix connector. Connectors are generically built up of two plug-in parts, of which a first part is designed as free connector, as shown in FIG. 3, and a second designed as a mounted connector, for mounting on the housing, as shown in FIG. 1. Such pairs of plug-in connectors are generally referred to as connectors or in the present case as matrix connectors. The matrix connector according to the present invention is described in its parts as follows.

Matrix Connector (Mounted Connector)

FIG. 1 shows the multipole matrix connector in the present invention respectively a part of the multipole matrix connector in the present invention 1, surrounded by a mounted housing 2. The mounted housing 2 is essentially so designed that it includes a housing flange 4 which is essentially designed flat and protrudes over the contour of the mounted housing 2. In this way such a matrix connector 1 can be inserted into an appropriate housing hole of an instrument or housing not shown. The housing flange 4 further includes in its corners mounting holes 3*a*, 3*b*, 3*c*, 3*d*, which serve to insert mounted housings with the array of contacts 13 inside into the provided housing hole and to firmly fix this with the mounting holes. Furthermore the mounted housing 2 includes a surrounding chamber wall 7 protruding out of the flange, which on the one hand is circumferentially closed and on the other hand is connected in its middle with a bridge 8. The chamber wall 7 is so designed on the mounted housing 2, that holes are formed for accommodating housing inserts 18, on the one hand from the chamber wall 7 and on the other hand from the bridge 8, and from the side walls of the mounted housing 2, which extend over the whole height of the mounted housing. In the bridge 8 and in the lateral sections of the chamber wall 7 are recesses 6*a*, 6*b*, 6*c*, 6*d*, which serve to position a housing insert in a given orientation, which is in addition suitable to be accommodated in the mounted housing 2. The multipole matrix connector in the present invention 1 includes inserted housing inserts 18 besides the mounted housing 2, which in their dimensions are tailored to the holes in the mounted housing and the accommodations 5 inside in the recesses 6*a*, 6*b*, 6*c*, 6*d*.

Figure 2:
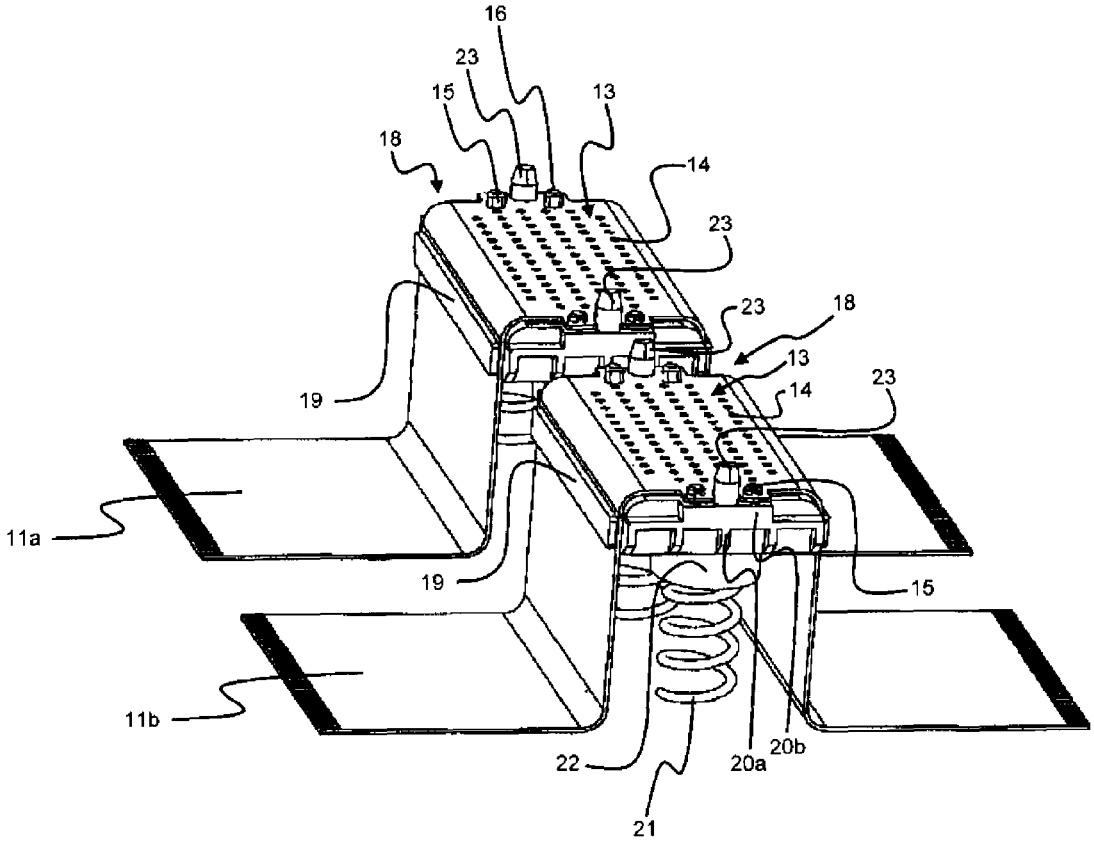

As further shown in FIG. 1, the bridge 8 includes a guide hole 9, in which there is in turn a groove 10 at the level of the bridge 8. This guide hole 9 serves amongst other things to correctly position the part of the matrix connector shown in FIG. 3 with the mounted housing, which then causes the contacts, which are correspondingly arranged with each other, to be correctly aligned in their position. In the mounted housing 2, as shown in FIG. 1, are mounted the arrays of contacts 13, which are part of the flexible printed circuit boards 11*a*, 11*b*. The arrays of contacts 13 include a variety of contact elements 14 arranged in a fixed grid, which is located on the surface of the flexible printed circuit boards 11*a*, 11*b*. As clearly shown in FIG. 2, the housing inserts 18 are assembled with the flexible printed circuit boards 11*a*, 11*b* in such a way, that the sections of the flexible printed circuit boards 11*a*, 11*b*, which include the array of contacts 13, are on the top of the housing inserts 18, whereas the other part of the flexible printed circuit boards 11*a*, 11*b* are bent around the housing inserts, so that these can be inserted underneath in the mounted housing 2. In the present invention the housing inserts 18 include two laterally attached guide ribs 20*a*, 20*b*; however the guide ribs 20*b* are suitable for immerging into the recesses 6*a*, 6*b*, 6*c*, 6*d* of the mounted housing 2 and the guide ribs 20*a*, 20*b* can be additionally guided to further guide levels. Furthermore the housing inserts 18 include spring recesses 22, which are essentially circular, cylindrical spring recesses 22 extending downwards under the housing inserts 18, to accommodate the springs 21. Preferably two essentially symmetrically-designed spring accommodations 22 are designed on each housing insert 18, which each accommodate one spring 21. The spring 21 is inserted on one end into the spring recess 22 and can be supported on the other end at a suitable point, which for example can be provided by a contour in the housing 2. If the housing inserts 18 with the mounted flexible printed circuit boards 11*a*, 11*b* from FIG. 2 are inserted in the housing 2 from FIG. 1, then these are flexibly mounted and can be cushioned along a defined path in the recesses 6*a*, 6*b*, 6*c*, 6*d*. This ensures, that in the plugged-in state, where the matrix connector 1*a* in FIG. 1 is plugged together with matrix connector 1*b* in FIG. 3, the normal force of the contact is applied that is necessary for contacting the contact elements 14 of the corresponding array of contacts 13. Through a suitable choice of the springs 21, according to the present invention, the spring tension and thus the contact pressing force of such a matrix connector can be defined precisely and aligned to the given application. In particular through increasing the number of the contact elements 14 in the array of contacts 13, the contact characteristics of such a multipole matrix connector can be optimised and improved by increasing the spring tensions of the springs 21.

For holding the flexible printed circuit boards 11*a*, 11*b* to the housing inserts 18 better, a pass band 19 is provided above the flexible printed circuit boards 11*a*, 11*b* and connected to the housing inserts 18. Thus the flexible printed circuit board lying between the pass band 19 and the housing insert 18, or respectively the printed circuit board section lying between these, is pressed with a defined force and secured against slipping or shifting. For further positioning and alignment of the flexible printed circuit board in the multipole matrix connector 1, lugs 15 are laterally mounted on the respective flexible printed circuit boards 11*a*, 11*b*, which in turn are interrupted by an essential U-shaped opening for the projecting through of further guiding devices 23. The lugs 15 are connected with the housing insert 18 with a connecting device 16, preferably with screws. Thus in connection with the above-mentioned pass bands 19, an exact position of the flexible printed circuit boards 11*a*, 11*b* in relation to the housing insert 18 can be defined and specified. The guiding devices 23, which are mounted on the sides of the housing inserts 18, serve in turn for the correct and exact alignment of the housing inserts 18, with regard to the mounted housing 2 and thus to the matrix connector pair 1*b* in FIG. 3 corresponding to the mounted housing 2. The guiding devices 23 are preferably designed as essentially cylindrical pins, which at their ends are somewhat pointed for guiding into the corresponding holes and thus for self-alignment of the connector in the connecting process. As is clearly visible particularly in FIG. 3, the matrix connector 1 with its second matrix connector part 1*b* has a further guiding device 23, which is essentially positioned in the centre of the second matrix connector part 1*b*. This guiding device 23 is also designed as an essentially cylindrical pin with a pointed end, and a notch 30 along the level of the pin, which can immerge into the guide hole 9 in the groove 10 shown in FIG. 1. Thus it is ensured that the connector and particularly the matrix connector 1 shown here cannot be plugged in incorrectly, i.e. in a 180° twisted position. The groove 10 thus has a task to polarise and correctly align the second connector part 1*b* with the first connector part 1*a*, thus for the whole matrix connector 1. The second matrix connector part 1*b* includes a housing 26, in which the corresponding arrays of contacts 13 are mounted in a recess 27, thus set towards the back. These arrays of contacts can be designed as fixed, massive printed circuit boards, as shown here with a variety of contact elements 14, which lie on the surface of the circuit boards 28*a*, 28*b* or also can be replaced in a suitable manner by flexible printed circuit boards. In the printed circuit boards 28*a*, 28*b* are furthermore holes 29 designated which in their position correspondingly match with the guiding devices 23 shown her in FIG. 1 or FIG. 2 respectively.

LIST OF REFERENCE CHARACTERS

Multipole Matrix Connector

1 Matrix connector
1*a* first plug-in connector
1*b* second plug-in connector
2 mounted housing
3*a, b, c, d* mounting holes
4 housing flange
5 accommodation
6*a, b, c, d* recesses
7 chamber wall
8 bridge
9 guide holes
10 groove
11*a, b* flexible printed circuit boards
12 conducting path connections
13 array of contacts
14 contact elements
15 lug
16 connecting device
18 housing inserts
19 pass band
20*a, b* guide ribs
21 spring
22 spring recess
23 further guiding devices
24 connecting device
26 housing
27 recess
28*a, b* printed circuit boards
29 holes
30 notch

The invention claimed is:

1. A matrix connector comprising:

a first plug-in connector having a first housing with two flexible printed circuit boards mounted therein, the two flexible printed circuit boards having a bridge therebetween, each flexible printed circuit board having at least one array of first contacts; and a second plug-in connector designed to mate with the first plug-in connector, the second plug-in connector having a second housing with a recess, the recess having at least one array of second contacts mounted therein, wherein the first plug-in connector has at least one first guiding device protruding therefrom, and a first guide hole disposed in the bridge, wherein the second plug-in connector has a second guiding device protruding therefrom, and at least one second guide hole, wherein upon mating of the first plug-in connector and the second plug-in connector, the at least one first guiding device is accepted into the at least one second guide hole and the second guiding device is accepted into the first guide hole, and wherein the first guide hole has a groove designed to accept a notch disposed on the second guiding device, the groove and notch configured to ensure correct alignment of the first plug-in connector and the second plug-in connector.

2. The matrix connector according to claim 1, wherein the at least one first guiding device or the second guiding device includes a coding and a lock.

3. The matrix connector according to claim 1, further comprising at least one housing insert mounted in the first housing, wherein each flexible printed circuit board is firmly connected to a corresponding housing insert.

4. The matrix connector according to claim 3, wherein each housing insert has side surfaces, and wherein each flexible printed circuit board is connected to at least one side surface of the corresponding housing insert with at least one pass band.

5. The matrix connector according to claim 3, wherein each flexible printed circuit board is connected to the corresponding housing insert with connecting devices.

6. The matrix connector according to claim 5, wherein each housing insert has guide ribs, and wherein the connecting devices are lugs connected to the guide ribs.

7. The matrix connector according to claim 3, wherein each housing insert has at least one spring recess.

8. The matrix connector according to claim 7, wherein upon the mating of the first plug-in connector and the second plug-in connector, a contact force between the array of first contacts and the array of second contacts is essentially created by the spring tension of the springs.

9. The matrix connector according to claim 7, wherein each spring recess has at least one spring inserted therein.

10. The matrix connector according to claim 9, wherein each housing insert is mounted flexibly in the first housing by means of the springs.

* * * * *